US008398217B2

(12) United States Patent
Manders et al.

(10) Patent No.: US 8,398,217 B2
(45) Date of Patent: Mar. 19, 2013

(54) INKJET PRINTING DEVICE

(75) Inventors: Martinus Gerardus Jozef Manders, Boxmeer (NL); Franciscus Wilhelmus Johanna Gerardus van de Kruijs, Deurne (NL)

(73) Assignee: Stork Prints B.V., Boxmeer (NL)

( * ) Notice: Subject to any disclaimer, the term of this patent is extended or adjusted under 35 U.S.C. 154(b) by 271 days.

(21) Appl. No.: 12/994,312

(22) PCT Filed: May 28, 2009

(86) PCT No.: PCT/EP2009/004023

§ 371 (c)(1),
(2), (4) Date: Nov. 23, 2010

(87) PCT Pub. No.: WO2009/144040

PCT Pub. Date: Dec. 3, 2009

(65) Prior Publication Data

US 2011/0074887 A1 Mar. 31, 2011

(30) Foreign Application Priority Data

May 29, 2008 (EP) ..... 08075523

(51) Int. Cl.
*B41J 2/18* (2006.01)
*B41J 2/175* (2006.01)

(52) U.S. Cl. ..... 347/85; 347/54

(58) Field of Classification Search ..... 347/54, 347/85–91

See application file for complete search history.

*Primary Examiner* — Kevin S Wood

(74) *Attorney, Agent, or Firm* — Ryan A. Schneider, Esq.; Troutman Sanders LLP

(57) ABSTRACT

Drop-on-demand inkjet printing device (10) comprising a through-flow print head (20) having nozzles (22) and a fluid circulation system comprising a main reservoir (30), a supply buffer tank (38), a return manifold (64), wherein the main reservoir (30) is connected to the supply buffer tank (38) wherein the supply buffer tank (38) is in fluid communication with the nozzles (22) print head (20) the nozzles (22) being in fluid communication with the return manifold (38) wherein the return manifold (64) is connected to the main reservoir (30) and both are arranged in height with respect to the nozzles (22), wherein the supply buffer tank (38) is provided with a lockable conduit (56) connecting the supply buffer tank (38) to the main reservoir (30).

11 Claims, 3 Drawing Sheets

INKJET PRINTING DEVICE

CROSS-REFERENCE TO RELATED APPLICATIONS

This application is a US National Stage of International Application No. PCT/EP2009/004023, filed 28 May 2009, which claims the benefit of EP 08075523.4, filed 29 May 2008.

FIELD OF THE INVENTION

The invention is directed to inkjet printing, more particularly to a drop-on-demand inkjet printing device having a through-flow print head.

BACKGROUND OF THE INVENTION

Inkjet printing devices having a through-flow print head are known in the art, e.g. from WO 2006/030235 A2 and WO 2006/064036 A1. In print heads having a through-flow arrangement fluid is removed continuously from the nozzle(s) in order to remove dirt and air bubbles that might block the nozzle or otherwise might affect a correct operation. Also heat generated by the electronic components of the print head, for example the piezo transducer used for generating drops of fluid, is removed, thereby conditioning the temperature of the fluid in the print head, which is significant as the fluid viscosity and consequently jetting properties of the fluid are dependent from the temperature. Inkjet printing heads are designed for either continuous drop generation or drop generation on demand. In drop-on-demand inkjet printing drops of fluid are only ejected from the respective nozzle(s), when such a drop is required for printing the substrate, contrary to continuous systems where a continuous stream of fluid drops is generated, a fluid drop being deflected to the substrate when it is required, while the remaining drops are collected. Drop-on-demand inkjet printing systems are usually further classified according to the drop generation principle, either thermal or piezo-electrical.

In inkjet print heads a slightly negative pressure or back pressure is required for operation. WO 2006/030235 A2 and WO 2006/064036 A1 both disclose fluid supply and circulation systems for use in inkjet printing devices having through-flow print heads, wherein the back pressure is controlled by active control of the pressures in a supply subtank supplying fluid to the nozzle of the through-flow print head and in a return subtank receiving fluid not consumed by the print head. The return subtank is connected to a main reservoir, from which the supply subtank is fed.

The subtanks and associated conduits contain a substantial volume of fluid, e.g. about 10 ml per print head. Upon interruption of a printing job, e.g. at the end thereof or because of temporarily failure, there is the risk of leaking fluid from these subtanks and associated conduits via the nozzle into a collecting tray or the like, because the slight negative pressure at the nozzle disappears, eventually resulting in almost complete emptying of the subtanks and associated subtanks. This risk is significant in inkjet printing devices, where the pressures in the subtanks is not actively monitored and controlled. The amount of fluid thus collected, which is to be disposed off as waste, could be relatively large. Disposal of valuable fluid adds to the costs. Furthermore restarting the device might be difficult.

BRIEF SUMMARY OF THE INVENTION

An object of the invention is to provide a drop-on-demand inkjet printing device comprising a through-flow print head, which does not have the above drawback or to a lesser extent.

Particularly it is an object of the invention to provide such a device, of which the generation of waste fluid is reduced upon interruption of its operation.

Yet another object of the invention is to provide such an apparatus without the need of adding expensive components like control valves, pumps and the like.

Still another object of the invention is to provide an inkjet printing device without actively controlled pressures in the subtanks.

One or more of the above objects are achieved by means of a drop-on-demand inkjet printing device according to the invention comprising at least one through-flow print head, the through-flow print head having one or more nozzles for ejecting a drop of fluid onto a substrate to be printed, and a fluid circulation system for feeding and circulating fluid through the print head, said fluid circulation system comprising

- a main reservoir for containing an amount of fluid,
- a supply buffer tank for receiving fluid from the main reservoir and supplying fluid to the through-flow print head,
- a return manifold for receiving fluid from the through-flow print head and returning fluid to the main reservoir, wherein the main reservoir is connected to the supply buffer tank via a feed conduit provided with a pump means for directing fluid from the main reservoir to the supply buffer tank, wherein the supply buffer tank is in fluid communication with the one or more nozzles of the through-flow print head via a nozzle supply conduit, the one or more nozzles being in fluid communication with the return manifold via a nozzle return conduit, wherein the return manifold is connected to the main reservoir via a discharge conduit, wherein the main reservoir and the supply buffer tank are arranged in height with respect to the one or more nozzles such that during operation a back pressure is established at the one or more nozzles and fluid flows from the supply buffer tank through the through-flow print head to the return manifold and then back into the main reservoir, wherein the supply buffer tank is provided with at least one lockable additional conduit connecting the supply buffer tank to the main reservoir.

The inkjet printing device according to the invention comprises one or more print heads of the through-flow type. The print head(s) may be arranged on a carriage, which is able to reciprocate in a scanning direction, usually perpendicular to a movement direction of a substrate being printed, such as a continuous web and the like. The print heads may also be arranged stationary in a staggered fashion. Usually the inkjet printing device will have one or more print heads for each colour to be printed, e.g. black (K), magenta (M), yellow (Y) and cyan (C). Each print head has at least one nozzle for ejecting a drop of fluid. Generally a plurality of nozzles is arranged in an array. A piezo-element may be used for generating a drop. In addition to ink fluids, a variety of other fluids can be used with the device according to the invention such as adhesives and the like. Fluid is fed to the print head by the fluid circulation system, which also maintains a circulation of fluid through the device. The fluid circulation system comprises inter alia a main reservoir adapted for containing a basic amount of fluid. The main reservoir may be replenished with fresh fluid from a storage vessel, if necessary, either continuously or intermittently. The main reservoir is open to the atmosphere and usually positioned at a low position on a stationary (sub)frame of the device. The main reservoir is connected to a supply buffer tank via a feed conduit. Fluid is fed from the main reservoir using a pump means that is provided in the feed conduit. The supply buffer tank is arranged at a supply level above the main reservoir. The supply buffer tank may be arranged on a stationary part of the device or on a reciprocating carriage. During operation the supply buffer tank is open to the atmosphere. Generally the supply buffer tank will be positioned in the direct vicinity of the through-flow print head in order to keep the required length of the nozzle supply conduit small. This nozzle supply conduit feeds fluid from the supply buffer tank to the nozzle(s) of the through-flow print head. A nozzle return conduit connects the nozzle(s) to the return manifold, which is closed to the atmosphere. Advantageously the return manifold may be provided with a de-aeration unit for start up in order to initiate fluid flow through the device, in particular the flow-through print head and to remove any air bubbles from the ink. The return manifold is positioned at a height in between the supply buffer tank and the print head. Thus the nozzle(s) of the print head are positioned at a lower position with respect to the buffer tank. A negative pressure or back pressure at the nozzle(s) is achieved by adjusting the hydrostatic pressure of the fluid column between the free surface level of fluid in the supply buffer tank and the meniscus of the fluid in the nozzle(s) and the hydrostatic pressure of the fluid column between the meniscus of the fluid in the nozzle(s) and the fluid level in the main reservoir, preferably by. adjusting the height positions of the supply buffer tank and main reservoir with respect to the nozzle(s). Fluid flow rate is also dependent from other parameters like the hydraulic resistance in the connecting conduits and print head, fluid viscosity, temperature and the like. Suitable height setting allows operating the device with a large variety of fluids without the need for additional adjustment. Furthermore additional control means for actively controlling the pressures in the supply buffer tank and return manifold are superfluous. The return manifold itself is connected to the main reservoir by means of a discharge conduit. Advantageously all conduits are made from flexible tubing that is resistant to the fluid concerned e.g solvent used as carrier in ink, and to the operating conditions.

According to the invention the inkjet printing device is also provided with at least one additional conduit—hereinafter also called a drain conduit in view of one of its functions—between the supply buffer tank and the main reservoir. This drain conduit is lockable or closable, meaning that the passage of fluids (air/ink) through the additional conduit can be interrupted. The drain conduit has two functions. As an air vent it provides an open communication between the supply buffer tank and the main reservoir during normal operation, as a result pressure in the supply buffer tank is also atmospheric pressure. Furthermore during normal operation of the inkjet printing device according to the invention fluid is fed from the main reservoir to the supply buffer tank by the pump means in amount sufficient to maintain the free surface level in the supply buffer tank at an essentially constant height, despite the fact that some fluid flows back from the supply buffer tank to the main reservoir via the drain conduit. Preferably, the aeration function and draining function are provided by one drain conduit, if it is has a sufficiently large cross section compared to the amounts of air and fluids flowing through the conduit in opposite directions. Thus such a single drain conduit allows air and ink to flow simultaneously in opposite directions. These functions mentioned above may also be provided by two or more separate conduits. Fluid also circulates from the supply buffer via the nozzle(s) of the print head and the return buffer supply to the main reservoir. Simultaneously printing is performed by ejecting fluid drops from the nozzle(s) on demand. When operation of the inkjet device according to the invention is interrupted, leakage of fluid from the nozzle(s) is prevented to a great extent by closing the drain connection. If the drain is closed, the pressure in the supply buffer tank will achieve a different rebalanced value because the drain and nozzle supply conduit act as communicating vessels. The same applies to the return manifold, where the nozzle return conduit and discharge conduit also would act as communicating vessels provided that a fluid column is maintained in the latter. E.g. by closing the discharge conduit, having the outlet thereof below the level of fluid in the main reservoir or having the inlet of the nozzle return conduit in the return manifold at a higher position than the outlet to the discharge conduit. Thereby at the nozzle a negative, although slightly different pressure is maintained preventing the leakage of an amount of fluid that otherwise would be wasted.

In a preferred embodiment the circulation system, in particular the main reservoir and drain conduit thereof are designed such that upon interrupting the operation of the device fluid contained in the main reservoir shuts off the drain. In this embodiment the amounts of fluid flowing through the drain conduit from the supply buffer tank and through the discharge conduit to the main reservoir cause a rise of the fluid level in the main reservoir until this level reaches the outlet of the drain conduit extending in the main vessel, thereby actually closing the drain conduit and as a result the open communication between the main reservoir and the supply buffer tank. This kind of closing induces the establishment of a new pressure balance in the supply buffer tank and associated conduits as explained above. In this embodiment the device according to the invention is self-regulating. This embodiment requires no additional control equipment.

In a further embodiment the inkjet device also comprises means for adjusting the height position of the outlet of the drain conduit in the main reservoir. This feature allows to operate the device according to the invention with different amounts of fluid circulating in the device.

In yet a further embodiment the main reservoir is provided with a float that is designed to float on the fluid contained in the main reservoir in an open position in which the outlet of the drain conduit is open at an operating level of the fluid in the main reservoir and a closed position in which the outlet of the drain conduit is closed by the float at a closing level of the fluid in the main reservoir. A float of this kind is able to effectively close the drain conduit outlet even at a small rise of the fluid level in the main reservoir.

In another embodiment of the inkjet printing device according to the invention the drain conduit is provided with a valve. When the device according to the invention is halted, the valve is switched from an open position to a closed position thereby closing the drain connection between the supply buffer tank and main reservoir.

In a particularly preferred embodiment the supply buffer tank is provided with an overflow, such as an overflow weir or wall having an overflow opening. The overflow divides the supply buffer tank into compartments. The first compartment thereof is supplied with fluid from the feed conduit. Fluid flows from the first compartment to the print head via the nozzle supply conduit. Excess fluid flows over the overflow into the second compartment, from which fluid is returned to the main reservoir via the drain conduit. The overflow is a preferred means for maintaining the free surface level of the fluid contained in the first compartment at an substantially constant value, resulting in an essentially constant head (column) of fluid and thus an essentially constant hydrostatic pressure in the nozzle. Advantageously the supply buffer tank, in particular the compartments, has a bottom outlet opening for connection to the nozzle supply conduit and a bottom outlet opening for connection to the drain conduit respectively.

In the return manifold the inlet opening for connecting the nozzle return conduit is preferably provided at a level above an outlet opening, advantageously a bottom outlet opening for connection to the discharge conduit.

As explained above, the inkjet printing device according to the invention may comprise more than one print head, e.g. 4 or 5. It is feasible that each print head has its own buffer tanks and related connections. However, in view of costs it is preferred that each print head in a multiple print head configurations is in fluid communication with a common supply buffer tank and a common return manifold.

BRIEF DESCRIPTION OF THE DRAWINGS

Hereinbelow the invention is illustrated in more detail in the attached drawing, wherein.

DETAILED DESCRIPTION OF PREFERRED EMBODIMENTS

Figure 1:
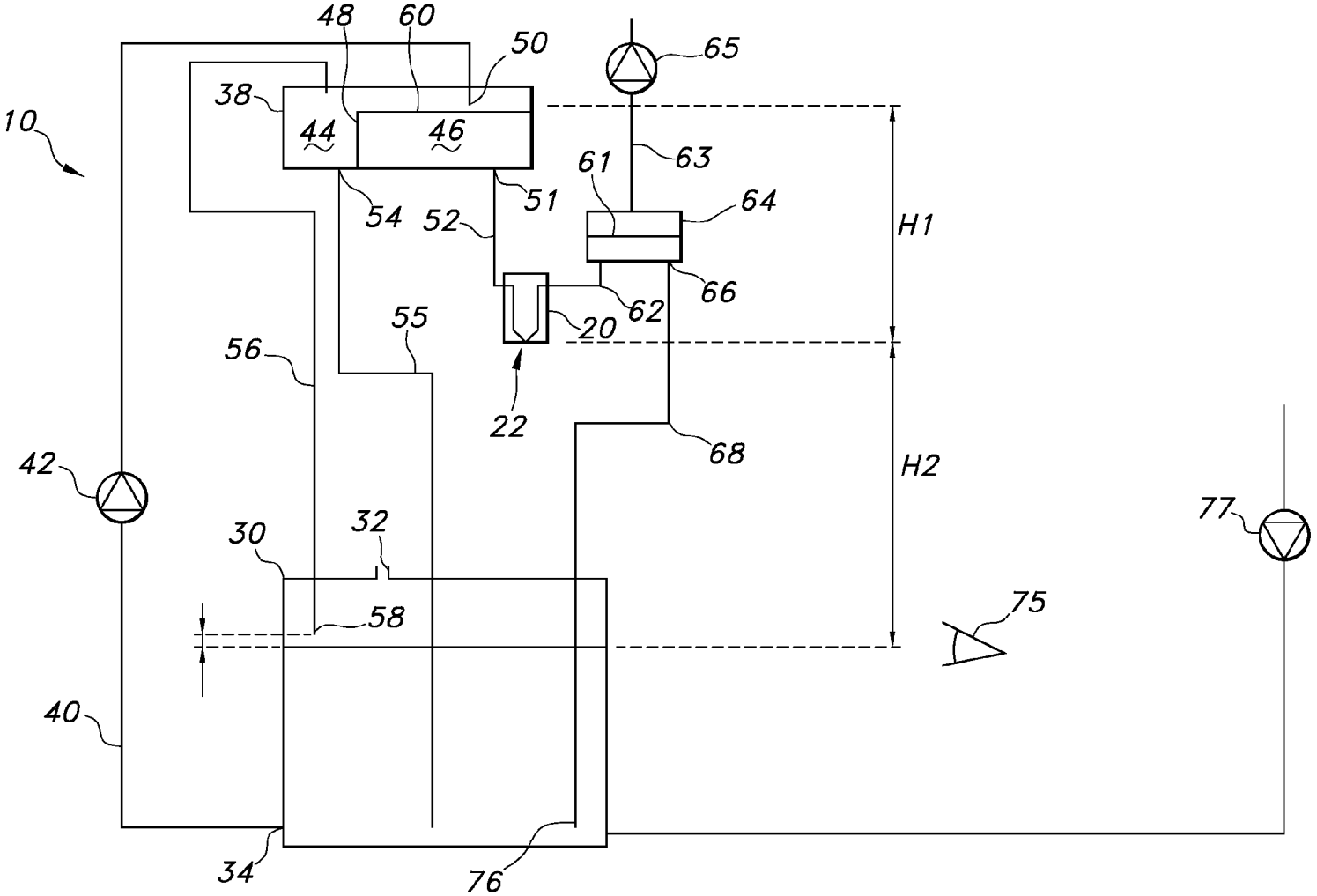
FIG. 1 is a diagram representing a first embodiment of the drop-on-demand inkjet printing device according to the invention.

In FIG. 1, an inkjet printing device is indicated by reference numeral 10. Basically the device 10 comprises a through-flow print head 20 having an array of nozzles 22 and a fluid supply and circulation system. In this embodiment this system comprises a main reservoir 30, which is in open communication to the atmosphere by means of a venting opening 32. The main reservoir 30 has an outlet 34 connected to an inlet 36 of a supply buffer tank 38 via a feed conduit 40 provided with a pump 42. The pump 42 draws fluid from the main reservoir 30 into the supply buffer tank 38. The supply buffer tank 38 is closed to the atmosphere. The supply buffer tank 38 comprises two compartments 44 and 46 separated from one another by means of an overflow weir 48. The outlet 50 of feed conduit 40 is "connected" to compartment 46. In this case the outlet 50 extends into the supply buffer tank 38 such that fluid flows into compartment 46. Compartment 46 is provided with a bottom outlet opening 51 and connected to the nozzle 22 by means of a nozzle supply conduit 52. The other compartment 44 is also provided with a bottom outlet opening 54 and connected to the main reservoir 30 via a drain conduit 55 extending below the fluid level in the main reservoir 30. having a drain outlet 58 arranged in the main reservoir 30 at a distance above the operating level of fluid in the main reservoir. The supply buffer tank 38 is also in open communication with the main reservoir 30 by means of second conduit 56, and as a result open to ambient air. This conduit 56 extends between the head spaces in the main reservoir 30 and the supply buffer tank 38. The free surface level 60 of fluid in compartment 46 is maintained at a height H1 with respect to the fluid meniscus in the nozzle(s) 22. H2 defines the height of the meniscus of the fluid in the nozzle(s) 22 with respect to the fluid level in the main reservoir 30. These heights control the fluid flow through the head 20 and the meniscus back pressure.

Upon operation the flow of fluid from the pump 42 into the supply buffer tank 38 is sufficient to keep the free surface level 60 of the fluid in the supply buffer tank 38 at an essentially constant level H1 above the meniscus of the fluid in the nozzle 22. In other words an essentially constant hydrostatic head is maintained during operation. Excess fluid flows from compartment 46 over the overflow weir 48 into compartment 44 and is returned to the main reservoir 30. A nozzle return conduit 62 connects the nozzle 22 to a return manifold 64, which is closed to the atmosphere. A de-aeration unit 65 connected via line 63 to the return manifold 64 may be provided in order to initiate fluid flow through the device like a siphon during start up procedures. The surface level of fluid in return manifold 64 is indicated by reference numeral 61. The return manifold 64 has a bottom outlet opening 66 connected to a discharge conduit 68, which opens into the main reservoir 30. The outlet 76 of the discharge conduit 68 is positioned below the fluid level in compartment 70. The operating fluid level in the main reservoir 30 is monitored by sensor 75. Pump 77 e.g. controlled by sensor 75, feeds fresh fluid from a storage tank or bag (not shown) to the main reservoir 30.

As explained above, the fluid circulation and supply system is designed such that upon interruption of the operation of the inkjet device 10 fluid continues to flow back from the supply buffer tank 38 via the drain conduit 55 and from the return manifold 64 via the discharge conduit 68 into the main reservoir 30. Because fluid is no longer pumped through the feed conduit 40 by means of pump 42, the fluid level in the main reservoir 30 rises to a closing level. As a result the outlet 58 of conduit 56 is closed by the fluid and the open communication of the supply buffer tank 38 to ambient air is interrupted. Fluid will be drawn to some extent into the drain conduit 56, until the pressure inside the supply buffer tank 38 has achieved a balanced valued due to the pressure head of fluid contained in the drain conduit 56 and the nozzle supply conduit 52. As a result flow of fluid in the nozzle supply conduit 52 will cease. At the other side of the system the pressure head of fluid contained in the nozzle return conduit 62 and the discharge conduit 68 will reach equilibrium, and fluid flow will stop, while maintaining the back pressure at the nozzle thereby preventing fluid leakage.

As an alternative to the self-regulating embodiment shown in FIG. 1 a valve provided in conduit 56, which is closed upon interruption of the operation of the device would have the same effect.

Figure 2:
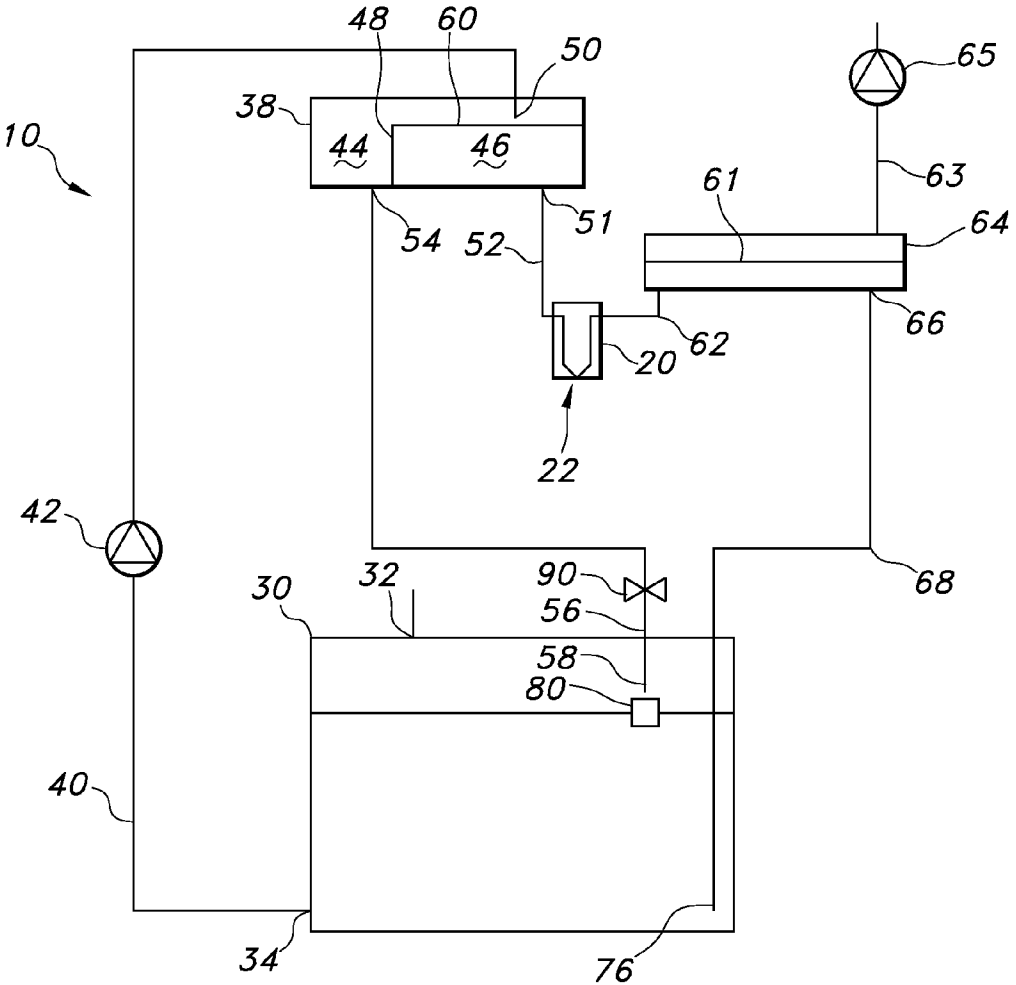
FIG. 2 is a diagram representing further variants of the device according to the invention.

FIG. 2 shows another embodiment of a drop-on-demand inkjet printing device 10 according to the invention. Elements identical to those of FIG. 1 are identified by the same reference numerals. In stead of a conduit 55 for draining and a conduit 56 for aeration, a single drain conduit 56 extends between the bottom outlet opening 54 of compartment 44 of supply buffer tank 38 and the free head space above the operating fluid level in main reservoir 30. The drain conduit/air vent 56 has a sufficiently large cross section to allow draining fluid from compartment 44 and maintaining supply buffer tank 38 open to ambient air during operation. Upon interruption the fluid level in main reservoir 30 rises to a closing level, wherein the fluid shuts off the outlet 58 of drain conduit 56 and interrupts the open communication of supply buffer tank 38 to the atmosphere. Main reservoir 30 is able to be replenished with fresh fluid, e.g. like FIG. 1.

FIG. 2 shows also two alternative embodiments. According to a first alternative a float 80 is arranged in main reservoir 30, which float closes the outlet 58 of the drain conduit 56 upon rise of the fluid level in reservoir 30. In another alternative the drain conduit 56 is provided with a switch valve 90 for opening and or closing the drain conduit 56.

Figure 3:
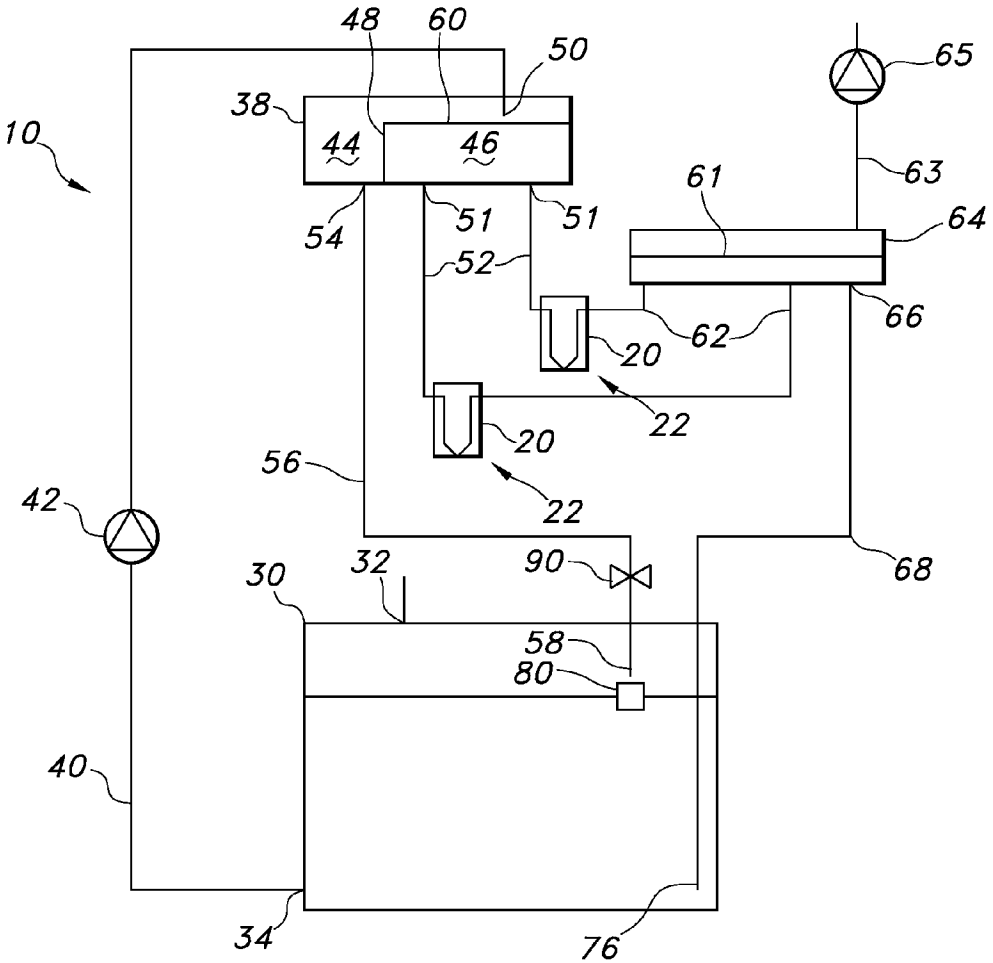
FIG. 3 is a diagram of an embodiment of an inkjet printing device according to the invention having multiple print heads.

FIG. 3 is an embodiment of an inkjet printing device 10 according to the invention having two print heads 20 provided with an arrays of nozzles 22. Again elements identical to those of FIGS. 1 and 2 are identified by the same reference numerals. As shown, the print heads 20 are each connected to the same supply buffer tank 38 and return manifold 64 by respective nozzle supply conduits 52 and nozzle return conduits 62.

What is claimed is:

1. Drop-on-demand inkjet printing device comprising at least one through-flow print head, the through-flow print head having one or more nozzles for ejecting a drop of fluid onto a substrate to be printed, and a fluid circulation system for feeding and circulating fluid through the print head, said fluid circulation system comprising:

a main reservoir for containing an amount of fluid, a supply buffer tank for receiving fluid from the main reservoir and supplying fluid to the through-flow print head, and a return manifold for receiving fluid from the through-flow print head and returning fluid to the main reservoir, wherein the main reservoir is connected to the supply buffer tank via a feed conduit provided with a pump means for directing fluid from the main reservoir to the supply buffer tank, wherein the supply buffer tank is in fluid communication with the one or more nozzles of the through-flow print head via a nozzle supply conduit, the one or more nozzles being in fluid communication with the return manifold via a nozzle return conduit, wherein the return manifold is connected to the main reservoir via a discharge conduit, wherein the main reservoir and the supply buffer tank are arranged in height with respect to the one or more nozzles such that during operation a back pressure is established at the one or more nozzles and fluid flows from the supply buffer tank through the through-flow print head to the return manifold and then back into the main reservoir, and wherein the supply buffer tank is provided with at least one further lockable conduit connecting the supply buffer tank to the main reservoir.

2. The inkjet printing device according to claim 1, wherein the fluid circulation system is designed such that upon interrupting the operation of the device essentially fluid contained in the main reservoir shuts off the conduit.

3. The inkjet printing device according to claim 1 further comprising adjusting means for adjusting the height position of the outlet of the conduit in the main reservoir.

4. The inkjet printing device according to claim 1, wherein the main reservoir is provided with a float that can float on the fluid contained in the main reservoir.

5. The inkjet printing device according to claim 1, wherein the conduit is provided with a valve.

6. The inkjet printing device according to claim 1, wherein the supply buffer tank is provided with an overflow dividing the supply buffer tank into a first compartment and a second compartment, the first compartment being connected to the feed conduit and to the nozzle supply conduit and the second compartment being connected to the at least one conduit.

7. The inkjet printing device according to claim 1, wherein the main reservoir is open to the atmosphere.

8. The inkjet printing device according to claim 1, wherein the return manifold is closed to the atmosphere.

9. The inkjet printing device according to claim 1 further comprising a plurality of through-flow print heads, each print head being in fluid communication with a common supply buffer tank and common return manifold.

10. The inkjet printing device according to claim 1, wherein the return manifold is provided with a de-aeration unit for start-up.

11. The inkjet printing device according to claim 1, wherein the main reservoir and at least one conduit are designed such that upon interrupting the operation of the device essentially fluid contained in the main reservoir shuts off the conduit.

* * * * *